US005139264A

United States Patent [19]

Wootten

[11] Patent Number: 5,139,264

[45] Date of Patent: Aug. 18, 1992

[54] GOLF TRAINING APPARATUS

[76] Inventor: Robert A. Wootten, 1310 Georgetown Rd., Boulder, Colo. 80303

[21] Appl. No.: 761,670

[22] Filed: Sep. 18, 1991

[51] Int. Cl.[5] ..... A63B 69/36

[52] U.S. Cl. ..... 273/191 R; 273/191 B; 273/186.1

[58] Field of Search ..... 273/191 R, 191 A, 191 B, 273/194 A, 186 R, 186 A, 29 A, 1.5 A, DIG. 30, 29 B, 29 F

[56] References Cited

U.S. PATENT DOCUMENTS

| | | | |
|---|---|---|---|
| 2,472,065 | 6/1949 | Cottingham | 273/191 R |
| 3,604,712 | 9/1971 | Prior et al. | 273/191 R |
| 3,752,476 | 8/1973 | Mahoney | 273/1.5 A |
| 3,876,212 | 4/1975 | Oppenheimer | 273/191 R |
| 4,040,633 | 8/1977 | Sciarrillo | 273/191 A |
| 4,047,605 | 9/1977 | Rosenvold | 273/186 R |
| 4,261,573 | 4/1981 | Richards | 273/191 R |
| 4,755,401 | 7/1988 | Friedrich et al. | 273/DIG. 30 |
| 4,949,974 | 8/1990 | Bellagamba . | |
| 5,050,874 | 9/1991 | Fitch | 273/191 B |

FOREIGN PATENT DOCUMENTS

| | | | |
|---|---|---|---|
| 3389 | 8/1932 | Australia | 273/29 BF |

OTHER PUBLICATIONS

The Dream Swing Machine, SwingTech, The Swinging, Perfect Swing, The Dunaway Way, and The Coach.

*Primary Examiner*—Paul E. Shapiro
*Assistant Examiner*—Steven B. Wong
*Attorney, Agent, or Firm*—Fields, Lewis, Pittenger & Rost

[57] ABSTRACT

Golf swing training apparatus disclosed includes a base, an upright support frame, rotary guide arm assembly at the top of the support frame establishing a reference axis of rotation at an inner arm portion and having an outer end flexibly coupled to the club head so that as the club is swung it is confined to a swing plane perpendicular to the reference axis of rotation. There is adjustment in frame height and angle of incline for the reference axis of rotation as well as adjustment in the drag. There is also a tensioning feature to dampen the inertia mass during the stroke.

22 Claims, 6 Drawing Sheets

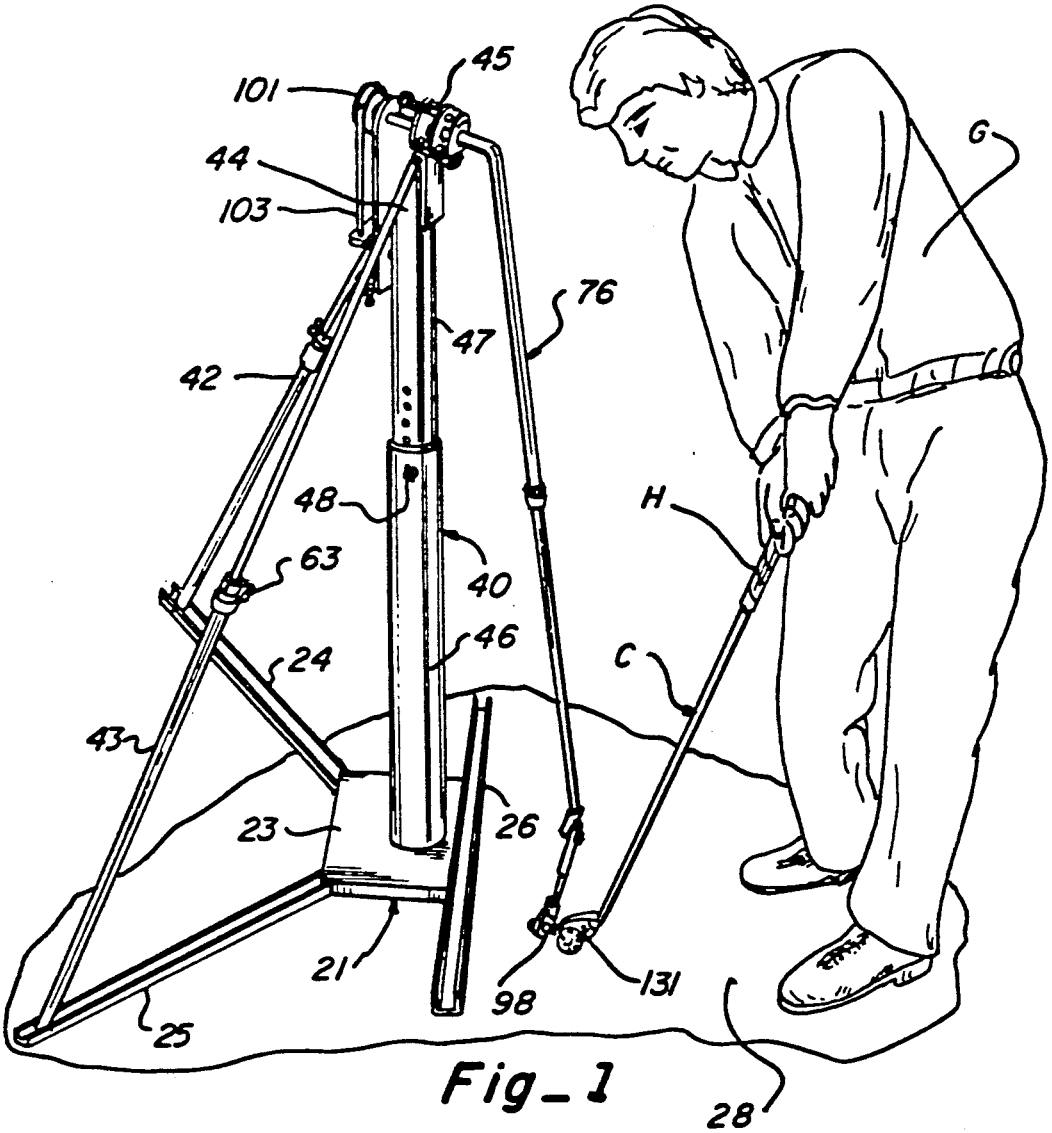
Fig_1
Fig_3
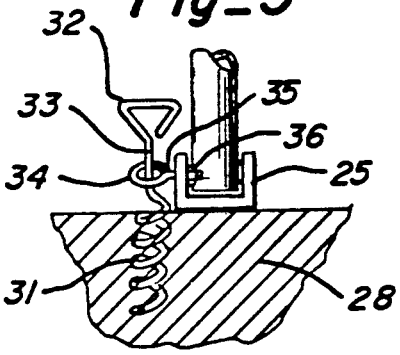
Fig_4
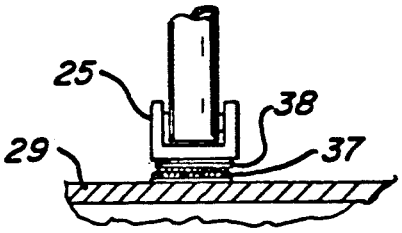

GOLF TRAINING APPARATUS

TECHNICAL FIELD

This invention relates to a novel and improved golf training apparatus for use in practicing a golf swing.

BACKGROUND ART

A proper golf swing is essential if a golfer is to hit a golf ball accurately with distance. The swinging of a golf club involves a complicated series of movements which require a considerable amount of practice to perfect. Strength in the arms, shoulders and legs as well as timing, balance and proper weight shift are all important factors that must be mastered for a proper golf swing.

Practice is essential to the attainment of a proper golf swing. Typically, a golf swing can be practiced by a golfer only at a golf course, a driving range or on a lawn or field, However, the need to travel to the course or driving range and the effects of adverse weather all combine to limit practice time. In addition, the demands of family and business further restrict the amount of time available for practice.

A number of golf swing training devices have heretofore been developed to enable a golfer to practice golf swings indoors or at a more convenient time without the need for travel to a golf course or driving range. One type of golf swing device disclosed in U.S. Pat. No. 4,949,974 includes a relatively large ring of circular tubing which guides the golf club in a generally planar path. Some other golf swing training apparatus currently on the market are identified in the advertising brochures as The Dream Swing Machine, SwingTech, The Swinging, Perfect Swing, the Dunaway Way and The Coach. Some golf swing practice devices merely strengthen muscles used in a golf swing rather than concentrating on the form of the swing or the coordination of movements in a golf swing.

While certain of these prior known devices are effective in enabling a golfer to practice and/or perfect a proper golf swing, each has limitations. Known golf practice devices are usually bulky and require large space for usage and storage. Other such devices do not employ an actual golf club when using the device and thereby do not come close enough to simulating an actual golf club swing.

DISCLOSURE OF INVENTION

A golf swing training apparatus disclosed is portable and can be quickly and easily set up and used, uses an actual golf club, increases the strength of the user as well as teaching proper coordination of movement and balance during a golf swing. The apparatus is adjustable in force resistance so as to enable its use by golfers having different strength levels of skill. The apparatus includes a base that is readily anchored to the support surface, an upright frame, and a rotary guide arm that connects to the golf club head to restrict the motion of the club head to a swing plane. The swing plane is adjustable to different angles with a horizontal plane. A tensioner dampens swing movements throughout the swing stroke.

BRIEF DESCRIPTION OF THE DRAWINGS

Details of this invention are described in connection with the accompanying drawings in which like parts bear similar reference numerals and in which:

FIG. 1 is a top perspective view of golf training apparatus embodying features of the present invention.

FIG. 3 is a sectional view showing the anchoring of the base leg to the earth.

FIG. 4 is a sectional view showing the anchoring of the base leg to a flooring.

DETAILED DESCRIPTION

Referring now to drawings there is shown golf swing training apparatus embodying features of the present invention which includes a base 21 having a flat, rectangular base plate 23 with two angled rear support legs 24 and 25 that are affixed to two corners along the rear side edge of the plate as by screw fasteners with the legs 24 and 25 forming an inside angle of about 60 degrees and extending radially out from the center of the plate 23. These rear legs 24 and 25 are preferably in the form of upright channels. A transverse front support leg 26 in the form of an upright channel is secured along the front side edge and extends parallel to the front side edge of the base plate 23 opposite the angled support legs.

Figure 2:
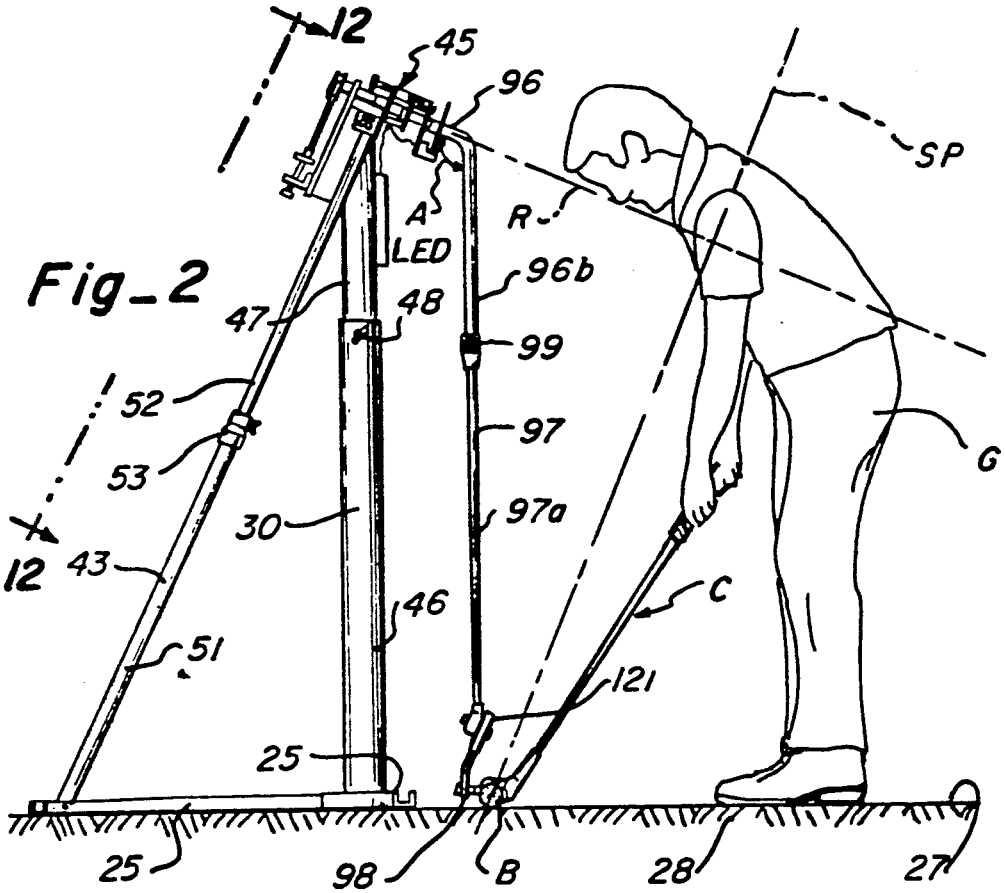
FIG. 2 is a side elevational view of FIG. 1.

The base 21 will typically rest on a support surface 27 such as provided by outdoor ground 28 as is illustrated in FIGS. 1, 2 and 3 or indoor flooring 29 as is illustrated in FIG. 4.

A suitable means for anchoring the base to the outdoor ground is shown in FIG. 3. This includes a dog-screw with a helical portion 31 at the bottom that threads into the ground and a top grip portion 32 with an intermediate shank 33. An eyebolt has an eyelet 34 that fits over the shank and a threaded portion 35 that extends through a hole in the leg of member 25 and a nut 36 threads on the threaded shaft of the eyebolt. A suitable means for anchoring the base to an indoor flooring 29 as shown in FIG. 4 is a Velcro-type fastener 37 secured to the flooring and a Velcro-type fastener 38 secured to the underside of the leg 25. This fastener is also known as a hook and pile fastener.

An upright frame on the base 21 includes a vertical truss section 40 and two identical angled truss sections 42 and 43 having a top mounting plate 44 affixed at the apex or top of the truss sections 40, 42 and 43 to connect the truss sections together A support assembly 45 is secured to the top mounting plate 44. The angled truss sections 42 are connected between an outer end of the angled support legs 24 and 25, respectively, and the mounting plate 44.

The vertical truss section 40 has an outer pipe 46 affixed at its lower end to a central part of the base plate 23 and an inner pipe 47 telescoping in the outer pipe with the pipes having suitable holes that align and receive a locking pin 48 to lock the pipes at a selected height and provide a height adjustment for the support assembly 45.

Figure 5:
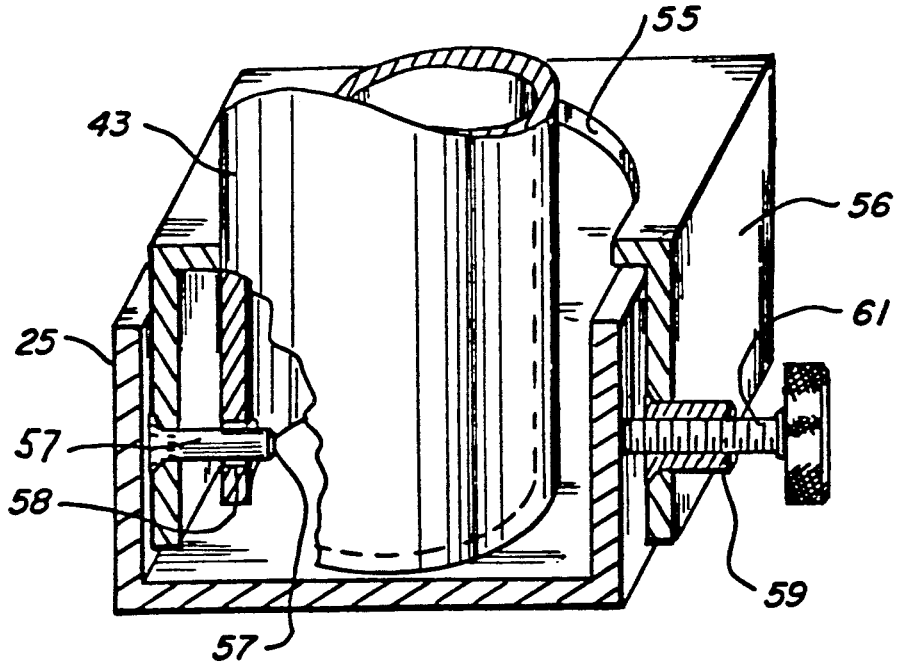
FIG. 5 is a perspective view showing the securing of the angled truss section to the base leg.

Each of the angled truss sections has an outer tube 51 having a lower end detachably secured to the end of the associated support leg and an inner tube 52 telescoping in the outer tube. As shown in FIG. 5 the lower end of outer tube 51 extends through an oval-shaped aperture 55 in an inverted channel member 56. The inverted channel member has an inturned pin 57 that extends through a hole 58 in the outer tube to secure the outer tube to the inverted channel member. The inverted channel member inserts into the support leg 25 with one leg inside the support leg and another leg outside the support leg. An internally threaded hub 59 on the outside leg of the internal channel receives a PEM bolt 61 having an end that bears against the leg of the support leg to lock the inverted channel to the support leg and release the inverted channel when the PEM bolt is unthreaded.

Figure 6:
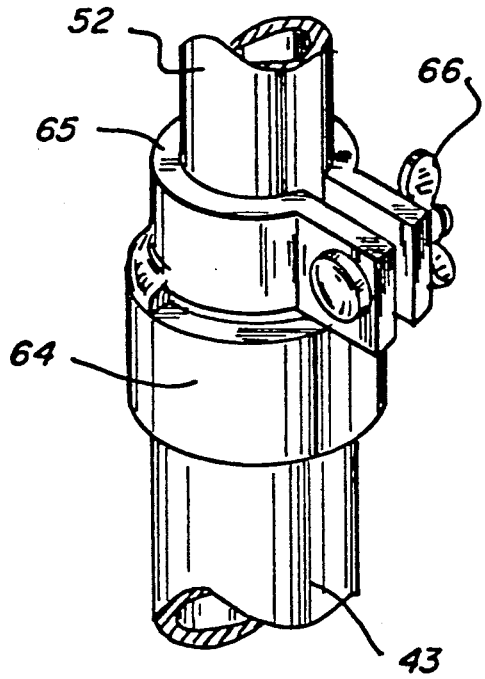
FIG. 6 is a perspective view of a portion of FIG. 2 showing the locking collar structure.

The outer tube 51 has the inner tube 52 secure at selected lengths by a collar type locking device 53 as best seen in FIG. 6. This locking device includes an outer pipe-type clamp 64 affixed to the outer tube and an inner pipe-type clamp 65 affixed to the outer pipe-type clamp with a fastening bolt 66 and associated nut that is turned to clamp against the inner tube to lock the outer and inner tubes at selected heights and provide height adjustment for the support assembly 45.

Figure 7A:
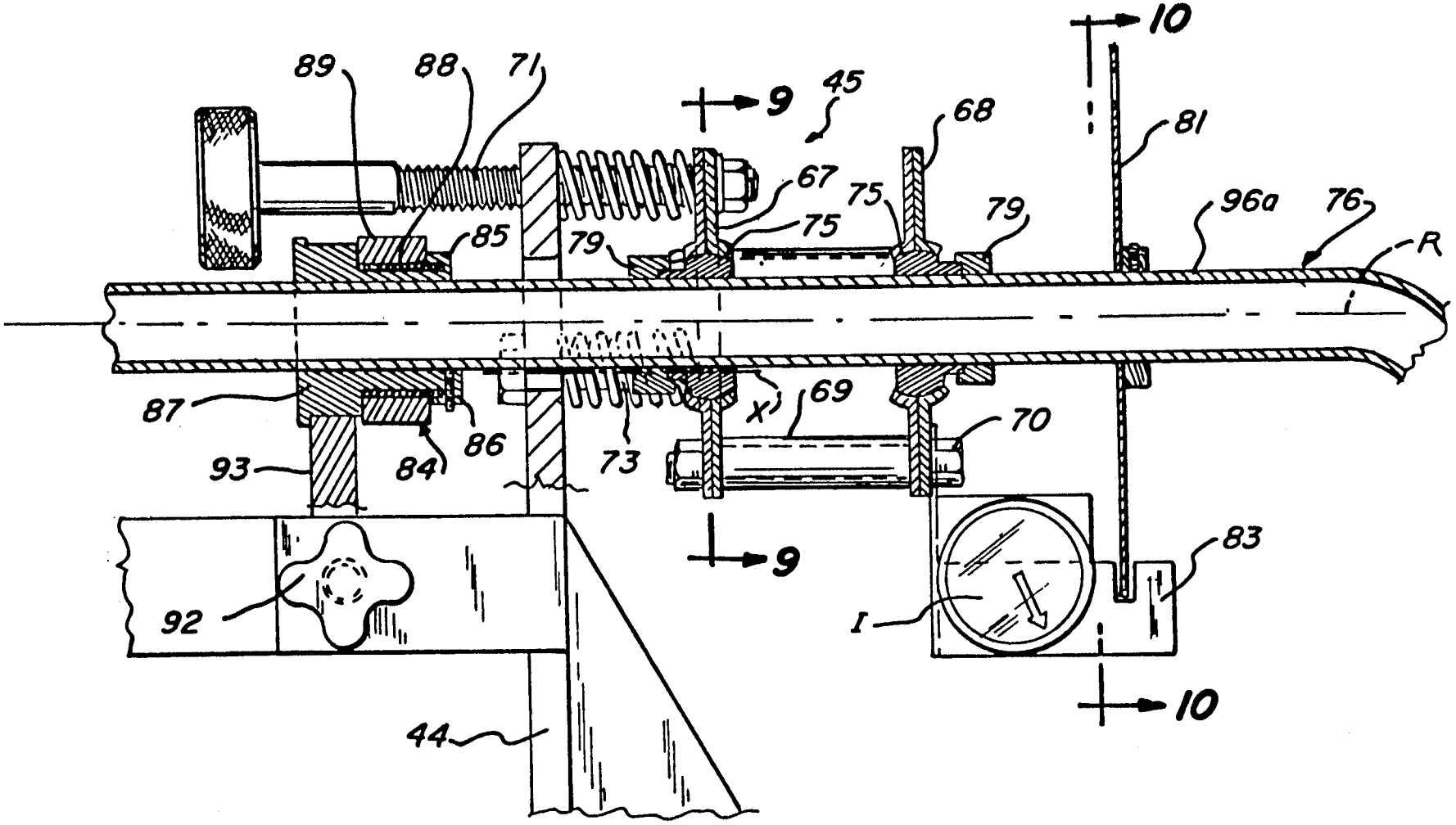
FIG. 7A is an enlarged side elevational view partially in section of the support assembly shown in FIG. 2.
Figure 7B:
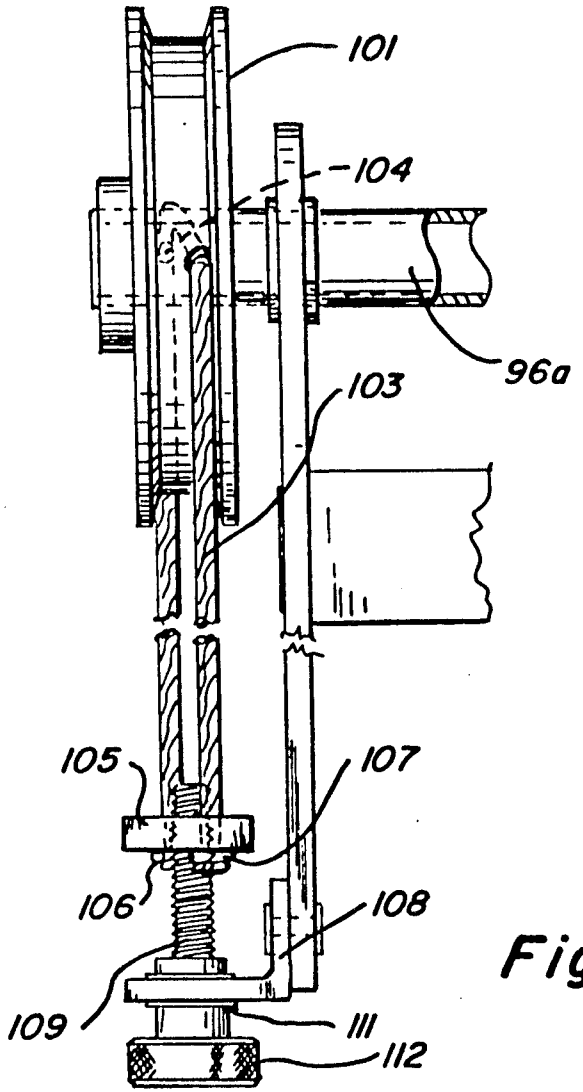
FIG. 7B is an enlarged side elevational view partially in section of the tensioner.

As best seen in FIG. 7A, the support assembly 45 includes a pair of axially spaced bearing plates 67 and 68 held a fixed distance apart by three spacing tubes 69 held together by a bolt and nut fastener 70. The bearing plates are held to the mounting plate by a top bolt 71 and two bottom bolts 72 and 73. The outer race of a spherical bearing 75 is mounted in the inside of each bearing plate and the inner race of the spherical bearing 75 is secured to an end portion of a rotary guide arm assembly 76 to support the rotary guide arm assembly 76 for rotation. A retainer ring 79 secured on the rotary guide arm assembly 76 at each end of the spherical bearings holds the bearings and bearing plates against axial movement on the shaft. A turning of the top bolt 71 will cause the rotary guide arm assembly 76 to rotate about the bottom bolts 73 at an axis indicated at X and this will vary the angle the axis of rotation of the inner end of the rotary guide arm assembly 76 has with respect to a horizontal plane and in turn vary the incline of the golfers swing plane designated R which may be varied or adjusted from about 55 to 75 degrees relative to the ground plane.

Figure 8:
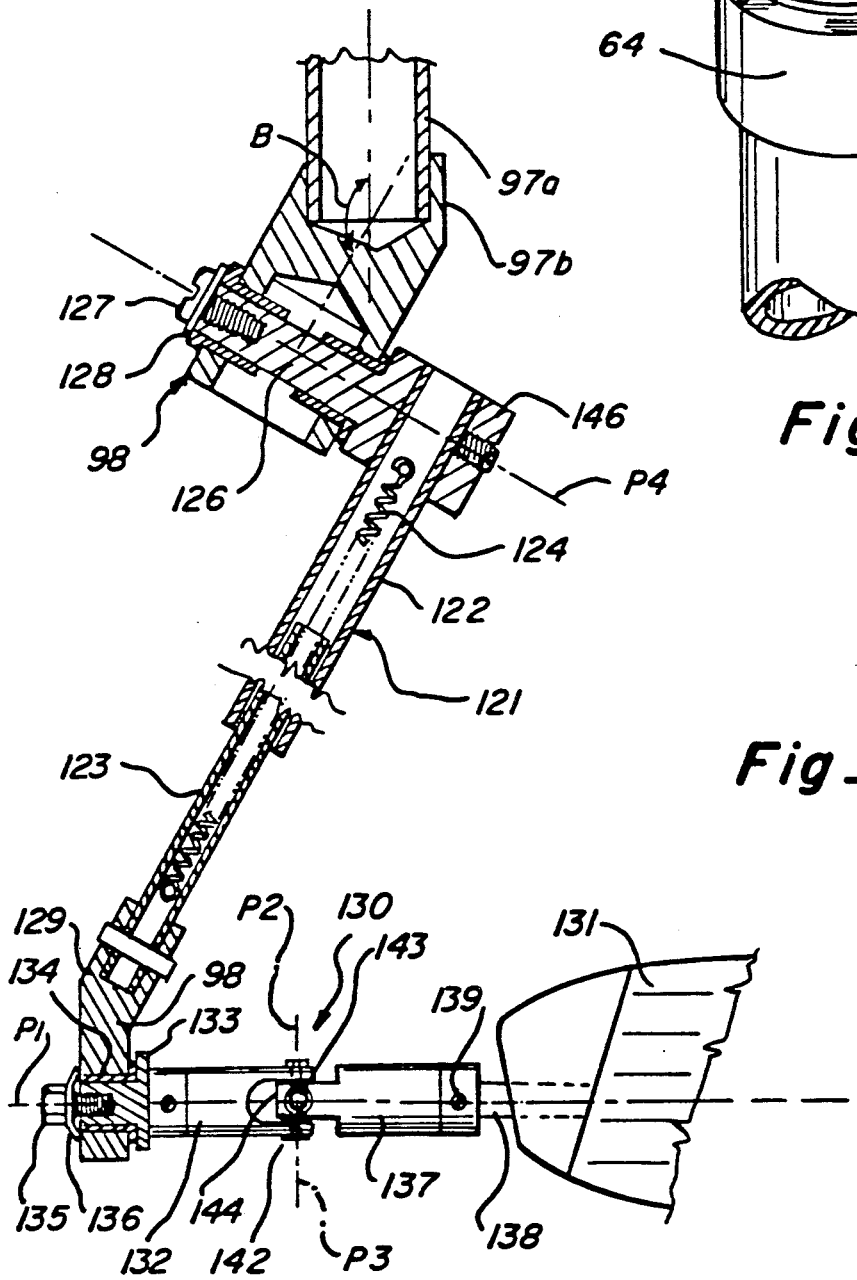
FIG. 8 is an enlarged side elevational view partially in section of the rotator arm portion, coupling assembly and club head.

Optical encoder is provided which includes a circular disc 81 with an arcuate slot 82 (FIG. 8) mounted on the inner end of the rotary guide arm assembly 76 and this rotates in a circumferential slot in a counter 83 to provide a reading of golf club head velocity. An electronic display ED is coupled to counter 83 and this with elements 81 and 83 provide an electronic feedback means indicating the velocity of each swing. An inclinometer I on the counter indicates the set angle of inclination for axis R.

Figure 9:
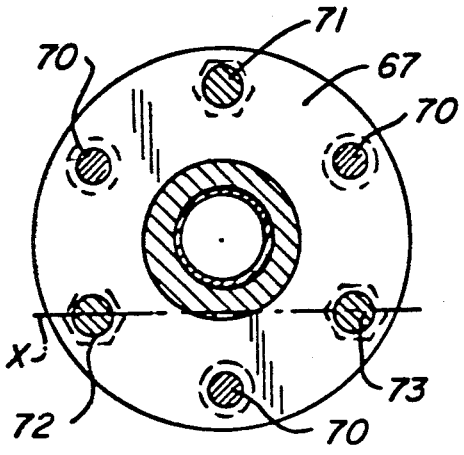
FIG. 9 is a sectional view along line 9—9 of FIG. 7.
Figure 10:
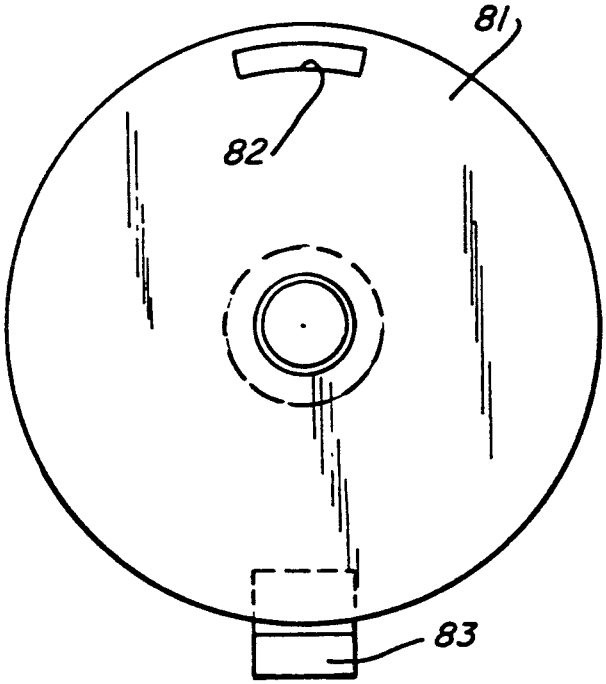
FIG. 10 is a sectional view along line 10—10 of FIG. 7.
Figure 11:
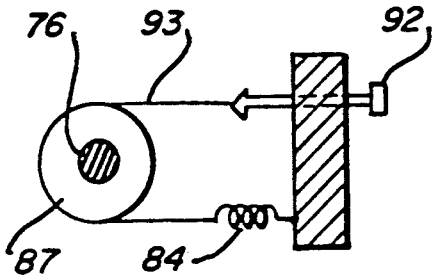
FIG. 11 is a schematic diagram of the adjuster for the clutch shown in FIG. 7.
Figure 14:
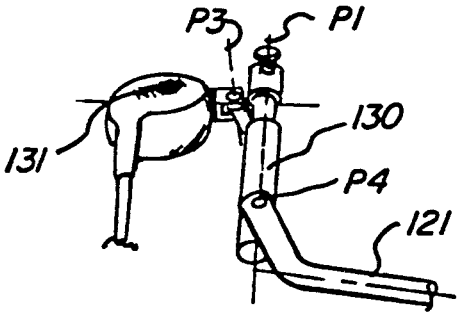
FIG. 14 is an enlarged front elevational view of a portion of FIG. 12 in the 12 o'clock position.
Figure 13:
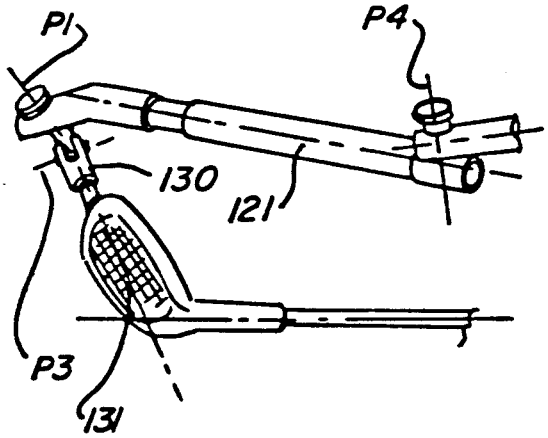
FIG. 13 is an enlarged front elevational view of a portion of FIG. 12 in the 9 o'clock position.
Figure 15:
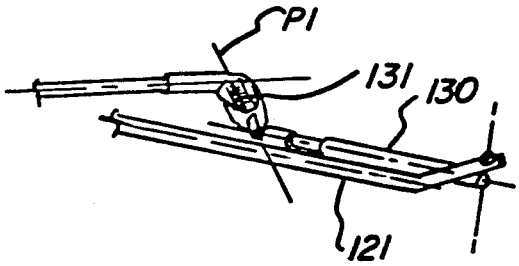
FIG. 15 is an enlarged front elevational view of a portion of FIG. 12 in the far back position.

A clutch assembly 84 (FIG. 7A) is mounted on an end portion of inner tube section 96*a* to provide a selected amount of drag on the golf club as it is moved through the golf swing to strike the ball. This clutch assembly 84 has a hub 85 secured to the inner arm section 96*a* by a set screw 86 and a hub 87 similar to and in an oppositely disposed relation to hub 85. A drive spring 88 fits around the hub 85 and has an end secured in an axial slot. A controller collar 89 fits around the spring. This clutch provides a drag in the swing direction and free rotation in the opposite direction. The clutch is actuated by blocking or releasing the collar 89. As seen in FIG. 9, rotation of a knob 92 adjusts a belt 93 having a spring 94 to vary the belt tension on the clutch to change the resistance to swinging the golf club. A clutch assembly found suitable for this purpose is a Model No. PSI-2 Warner Electric, Pittman, N.J.

In general, the rotary guide arm assembly 76 includes an inner arm portion 96, an outer arm portion 97 and end portion 98. The outer arm portion 97 extends at a selected angle A to the inner arm portion and at the at-rest starting position is in a vertical depending position. The end portion 98 is offset and generally parallel to the outer arm portion 97. In particular, the inner arm portion 96 is in the form of a tubular member with a bend 90 intermediate its ends to form an inner tube section 96*a* and an outer tube section 96*b*. The inner tube section 96*a* is journaled in the spherical bearings 75 for rotation about axis R. A straight tube section 97*a* telescopes in outer tube section 96*b* and tube sections 96*b* and 97*a* have a locking collar 99 to enable the adjusting of the length of the rotary guide arm assembly 76. The outer arm portion 97 has an outer end section 97*b* turned at a selected angle B so it is perpendicular to the axis of rotation R. The vertical adjustments of the angled support legs and assembly 76 allows the apparatus to be adjusted to accommodate golfers of various heights ranging from about 5'4" to 6'8".

A tensioning assembly is mounted on an end portion of inner tube section 96*a* to provide a selected amount of torsional resistance to counter balance and dampen the inertia mass of the rotary guide arm assembly 76 during the stroke. This tensioning assembly has a pulley 101 secured to the end of inner tube section 96*a* by a set screw. A flexible spring cord 103 extends radially through hole 104 in the rotary guide arm assembly 76 and pulley 101 and both ends extend downward to a translator block 105 with securing clamps 106 and 107. The translator block 105 is connected to the adjustment brace 108 by an adjustable bolt 109 and nut 111. At the end of the adjustable bolt 109 is a hand knob 112 that rotates for adjustment of tension of flexible spring cord 103. As the shaft rotates the cord winds on the pulley and this serves to dampen the inertia mass.

On the end portion 98 and specifically outer end section 97*b* of assembly 76 there is pivotally mounted a rotator arm portion 121. This portion 121 includes an outside tube section 122 and an inside tube section 123 telescoping in section 122 with a tension spring 124 connected to the tube sections to enable the length of the rotator arm portion to change or vary according to the force applied thereto as is described more fully hereafter. The inner end of the outer tube section 122 has an end connector 146 with a shaft 126 that extends through bearings in a hole in outer end section 97b. A bolt 127 and beveled washer 128 has the bolt 127 extending into and threading into internal threads in the shaft 126 to form a pivot axis P4 for the inner end of the rotator arm portion 121 with respect to the outer arm portion 97. The outer end of the rotator arm portion 121 has an angled connector 129 having the inner end affixed to the inside tube section 123 and the outer end turned at an angle to form the end portion 98 above described.

Figure 12:
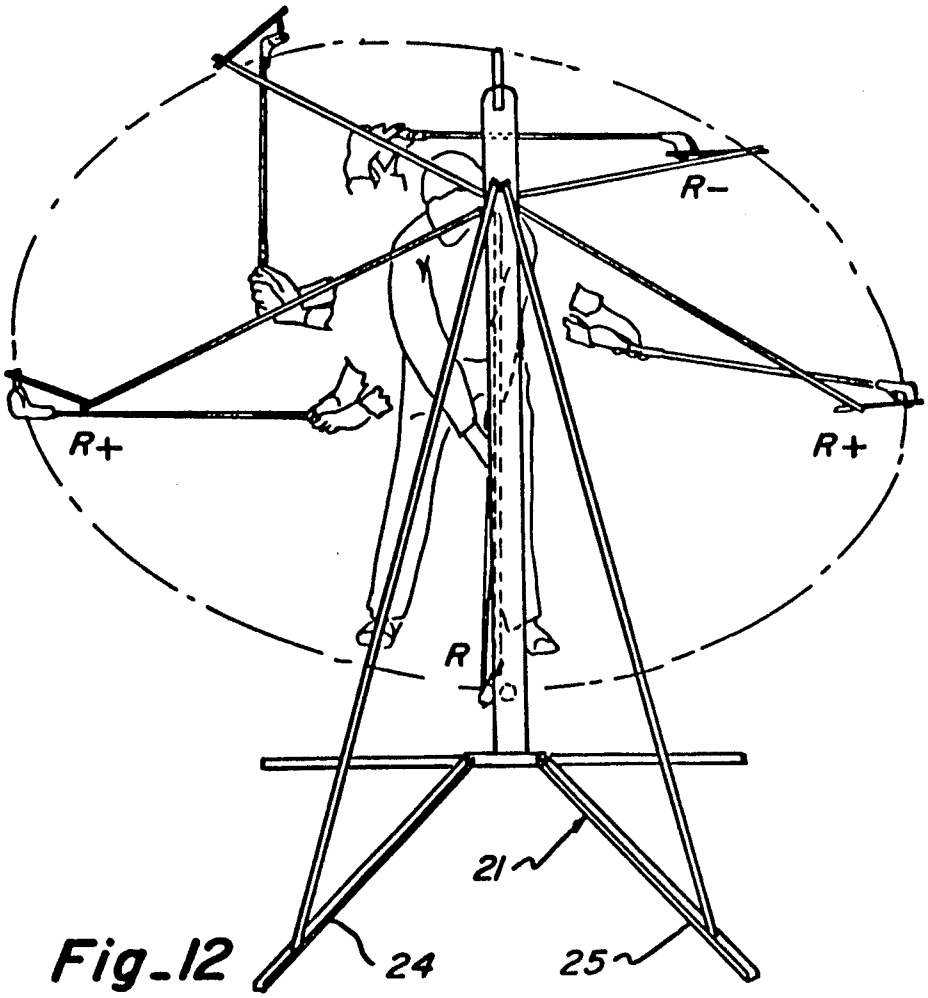
FIG. 12 is a front elevational view taken along line 12—12 of FIG. 2 showing the club and hands in several positions of the golf swing.

As seen in FIG. 12 during the swing the flexibility in rotator arm portion allows the club to follow an elliptical pattern. The length is R at the starting position. The length increases to R+ at the 9 o'clock and 3 o'clock positions of the stroke and is at a less than R or R− at the full backswing position.

A golf club C is shown in FIGS. 1 and 2 in front of the apparatus has a golf club grip H being gripped by a golfer G and the club head 131 is secured to the outer end of the rotary guide arm assembly 76 by a flexible coupling assembly 130. The flexible coupling assembly 130 enables the club head to rotate about three mutually perpendicular pivot axes designated P1, P2 and P3. As seen in FIG. 2 the swing plane SP that is perpendicular to axis of rotation R includes the shoulders of the golfer and the face of the club head 131 that strikes the ball B when the club head is in the starting position. Coupling assembly 130 includes a first pivotal connection at a pivot axis P1 provided by a first connecting shaft 132 having an end portion with a flange 133 that extends though a hole 134 in an end portion of the rotator arm. A bolt 135 with a beveled washer 136 threads into an internally threaded hole in shaft 132 to removably fasten the shaft 132 to the rotator arm. This allows the club head to rotate along its longitudinal axis with respect to the free end of the rotary guide arm assembly 76.

The coupling assembly 130 further has a second connecting shaft 137 connected at one end to a stud 138 affixed to and extending out of the club head 131 by a pin 139 to be rigidly affixed to the club head 131. The adjacent end of the two shafts are coupled by a U-type joint or coupling provided by a clevis 141 on the end of shaft 137 and a pin 142 on the other shaft 137 extending through holes in the clevis. The pin 142 rotating in the clevis 141 forms a second pivot connection at a pivot axis P2 which enables the club head to swing from side to side with respect to the free end of the guide arm assembly 76.

A second pin 143 in a clevis 144 in the end of the shaft 137 at right angles to pin 142 is rotatable in holes in the clevis forming a third pivot connection at a pivot axis P3 which enables the club head to pivot with respect to the free end of the shaft assembly to change the lie angle of the club head.

Although the present invention has been described with a certain degree of particularity, it is understood that the present disclosure has been made by way of example and that changes in details of structure may be made without departing from the spirit thereof.

What is claimed is:

1. Golf swing training apparatus comprising:

a base for support on a support surface, an upright frame on said base, rotary guide arm means for a golf club including an inner arm portion supported for rotation at the top of said frame about a reference axis of rotation at a selected angle to said support surface that is perpendicular to a golf swing plane which includes the shoulders of the golfer and a club face of said golf club for striking a golf ball in a starting position and an outer arm portion extending away from said inner arm portion and depending vertically in a starting position, said outer arm portion terminating in an outer end portion, and coupling means for connecting a club head of a golf club to said outer end portion so as to provide multi-axial movement of said club head with respect to said outer end portion, said coupling means having a first pivot connector providing for club head rotation about a first pivot axis to enable said club head to rotate about the longitudinal axis of said club head, a second pivot connector providing for club head rotation about a second pivot axis perpendicular to said first pivot axis to enable said club head to swing from side to side with respect to said outer end portion and a third pivot connector providing for club head rotation about a third pivot axis perpendicular to said first and second pivot axes to enable said club head to swing toward and away from said outer end portion, whereby upon the swinging of said golf club through a golf swing between the starting position to a straight back position in the back stroke and through a forward stroke to strike the ball by a golfer gripping a handle of said golf club the motion of said club head is restricted to substantially said golf swing plane.

2. Golf swing training apparatus as set forth in claim 1 wherein said base includes a flat base plate with a rear side edge and two rear corners and a front side edge, two angled rear support legs affixed at said rear corners, said rear support legs being disposed at an angle to one another to form an inside angle of about 60 degrees and a transverse front leg affixed to said front side edge, said rear and front legs being in the form of upright channels.

3. Golf swing training apparatus as set forth in claim 1 including means for releasably attaching said base to said support surface.

4. Golf swing training apparatus as set forth in claim 3 wherein said support surface is provided by outdoor ground and said means for releasably attaching includes a screw threaded into the ground, an eyebolt fastened to a shank of said screw and fastened to said base.

5. Golf swing training apparatus as set forth in claim 3 wherein said support surface is provided by interior flooring and said means for releasably attaching includes hook-pile fasteners on said base and said flooring.

6. Golf swing training apparatus as set forth in claim 1 wherein said frame includes a vertical truss section and two upright angular truss sections.

7. Golf swing training apparatus as set forth in claim 6 wherein said vertical truss section is made of telescoping outer and inner pipe sections held together at selected length dimensions by a removable pin extending through selected apertures in said outer and inner pipe sections to vary the length of said vertical truss section.

8. Golf swing training apparatus as set forth in claim 6 wherein each of said angular truss sections is made of telescoping outer and inner tube sections held together at selected length dimensions by a locking collar operatively associated with said outer and inner tube sections to vary the length of said angular truss section.

9. Golf swing training apparatus as set forth in claim 6 including means for releasably fastening said angular truss sections to said base, said fastening means including an inverted channel having an aperture into which the lower end of one of said tube sections extends, a pin extending from one leg of the inverted channel securing said one leg thereto and fastening means to releasably secure said inverted channel to said base.

10. Golf swing training apparatus as set forth in claim 1 wherein said support means includes a mounting plate and pair of axially spaced bearing plates held a fixed distance apart by spacing tubes, top bolt means extending through said bearing plates and bottom bolt means extending through said bearing plates whereby the adjustment of said top bolt means changes the reference angle of rotation with respect to said support surface.

11. Golf swing training apparatus as set forth in claim 1 wherein said rotary guide arm means includes generally tubular body means that extends from the top of said frame to approximately the golf ball in said starting position.

12. Golf swing training apparatus as set forth in claim 1 wherein said inner arm portion is provided by a tubular member having an inner tube section mounted for rotation in bearings and an outer tube section disposed at a selected angle to said inner tube section, said tubular member having a bend of a selected angle intermediate the ends thereof, and a straight tube section telescopingly received in said outer tube section, said outer tube section and straight tube section having locking means to vary the length of said inner arm portion.

13. Golf swing training apparatus as set forth in claim 1 including a rotator arm portion having a pivotal connector at an outer end of said outer arm portion to pivot in a plane perpendicular to said reference axis of rotation, said rotator arm portion being extensible and retractable to a selected length according to the swing force applied thereto whereby said rotary guide arm means follows a generally elliptical pattern during said golf swing.

14. Golf swing training apparatus as set forth in claim 1 wherein said first pivot connector includes a shaft assembly rigidly connected at one end to said club head and extending at an opposite end through a hole in said outer end portion.

15. Golf swing training apparatus as set forth in claim 1 wherein said second pivot connector includes a first shaft section and a second shaft section connected by a first clevis and a first pin.

16. Golf swing training apparatus as set forth in claim 1 wherein said third pivot connector includes a second clevis and a third pin at right angles to said first pin.

17. Golf swing training apparatus as set forth in claim 1 including frictional resistance means to vary the force required to swing said golf club through said golf swing plane in the forward stroke.

18. Golf swing training apparatus as set forth in claim 17 wherein said frictional resistance means is a one way clutch to provide for torsional resistance to the guide means in one direction and free rotation in the opposite direction.

19. Golf swing training apparatus as set forth in claim 1 including tensioning means to dampen the motion of the club head in both the back swing and the forward swing.

20. Golf swing training apparatus as set forth in claim 19 wherein said means includes a pulley movable with the movement of said club head with a flexible cord extending through said pulley that is secured at the ends and wraps around said pulley as the club head moves.

21. Golf swing training apparatus comprising:

a base for support on a ground plane, an upright frame on said base, support means at the top of said frame for establishing a reference axis of rotation at a selected angle to said ground plane that is perpendicular to a plane which includes the shoulders of the golfer and a club face of a golf club for striking a golf ball in a starting position, rotary guide arm means having an inclined inner arm portion supported for rotation about said axis of rotation by said support means, a straight outer arm portion extending away from said inner arm portion and disposed at a selected angle with said inner arm portion, said outer arm portion terminating in an outer end portion, said rotator guide arm means including a pivotal connector at an outer end of said outer arm portion to pivot in a plane perpendicular to said reference axis of rotation, said rotator arm portion being extensible and retractable to a selected length according to the swing force applied thereto whereby said rotary guide arm means follows a generally elliptical pattern during said golf swing, and coupling means for connecting a club head of said golf club to said outer end portion of said guide arm means, and provide free movement of said club head with respect to said outer end portion, said coupling means having a first pivot connector providing for club head rotation about a first pivot axis to enable said club head to rotate about the longitudinal axis of said club head, a second pivot connector providing for club head rotation about a second pivot axis perpendicular to said first pivot axis to enable said club head to swing from side to side with respect to said outer end portion and a third pivot connector providing for club head rotation about a third pivot axis perpendicular to said first and second pivot axes to enable said club head to swing toward and away from said outer end portion, whereby upon the swinging of said golf club through a golf swing between a depending down starting position to a straight back position in the back stroke through a full forward stroke by a golfer gripping a handle of said golf club the motion of said club head is restricted to substantially said golf swing plane.

22. Golf swing training apparatus comprising:

a base for support on a support surface, said base including a flat base plate with a rear side edge and two rear corners and a front side edge, two angled rear support legs affixed at said rear corners forming an inside angle of about 60 degrees and a transverse front leg affixed to said front side edge, said rear and front legs being in the form of upright channels, an upright frame on said base, said frame including a vertical truss section and two upright angular truss sections, support means at the top of said frame for establishing a reference axis of rotation at a selected angle to said ground plane that is perpendicular to a plane which includes the shoulders of the golfer and club face of said golf club that strikes a golf ball in a starting position, said support means including a mounting place and pair of axially spaced bearing plates held a fixed distance apart by spacing tubes, top bolt means extending through said bearing plates and bottom bolt means extending through said bearing plates whereby the adjustment of said top bolt means changes the reference angle of rotation with respect to said support surface, rotary guide arm means having a rigid inclined inner arm portion supported for rotation about said axis of rotation by said support means, a rigid substantially straight outer arm portion extending away from said inner arm portion and disposed at a selected angle with said inner arm portion, said outer arm portion terminating in an outer end portion, said rotator guide arm means including a pivotal connector at an outer end of said outer arm portion to pivot in a plane perpendicular to said reference axis of rotation, said rotator arm portion being extensible and retractable to a selected length according to the swing force applied thereto whereby said rotary guide arm means follows a generally elliptical pattern during said golf swing, coupling means for connecting a club head of a golf club to said outer end portion of said guide arm means, and provide free movement of said club head with respect to said outer end portion, said coupling means being arranged to enable said club head to move about three mutually perpendicular pivot axes, said coupling means having a first pivot connector providing for club head rotation about a first pivot axis to enable said club head to rotate about the longitudinal axis of said club head, a second pivot connector providing for club head rotation about a second pivot axis perpendicular to said first pivot axis to enable said club head to swing from side to side with respect to said outer end portion and a third pivot connector providing for club head rotation about a third pivot axis perpendicular to said first and second pivot axes to enable said club head to swing toward and away from said outer end portion, whereby upon the swinging of said golf club through a golf swing between a depending down starting position to a straight back position in the back stroke through a full forward stroke by a golfer gripping a handle of said golf club the motion of said club head is restricted to substantially said golf swing plane.

* * * * *